US006047968A

United States Patent [19]

Lu et al.

[11] Patent Number: 6,047,968

[45] Date of Patent: Apr. 11, 2000

[54] ELECTRONIC DART BOARD

[76] Inventors: Kuo-Hui Lu, 3F, No. 50, Lane 2, Sec. 2, Yan Jiow Yuann Rd., Taipei; Ching-Tai Yen, 4F, No. 11, Lane 474, Kang-Ning St., Hsi Chih, Taipei Hsien, both of Taiwan

[21] Appl. No.: 09/123,984

[22] Filed: Jul. 29, 1998

[51] Int. Cl.[7] ..... F41J 5/02

[52] U.S. Cl. ..... 273/371; 273/376

[58] Field of Search ..... 273/371, 374, 273/376, 403, 404, 408, 407

[56] References Cited

U.S. PATENT DOCUMENTS 5,482,291 1/1996 Houriet, Jr. et al. ..... 273/376

5,613,685 3/1997 Stewart et al. ..... 273/374

5,626,344 5/1997 Huang ..... 273/376

*Primary Examiner*—Jeanette Chapman

*Assistant Examiner*—M. Chambers

*Attorney, Agent, or Firm*—Varndell & Varndell PLLC

[57] ABSTRACT

An electronic dart board includes an outer frame shell having a plurality of partition ribs defining a set of scoring chambers, and a set of base blocks respectively mounted in the scoring chambers, wherein a set of block holders are respectively nested in the scoring chambers to hold the base blocks in the respective scoring chambers, the block holders fitting the scoring chambers respectively, each block holder having a plurality of less at a bottom side and at least one locating rib respectively engaged into a respective locating groove on the base blocks.

6 Claims, 6 Drawing Sheets

ELECTRONIC DART BOARD

BACKGROUND OF THE INVENTION (a) Field of the Invention:

The present invention relates to electronic dart boards, and more particularly to such an electronic dart board in which the base blocks are boxed in a respective block holder and nested in a respective scoring chamber within the front frame shell of the dart board.

(b) Description of the Prior Art:

Regular electronic dart boards with automatic scoring function include two types, one having cells at the front side for receiving the dart, the other having upright pegs at the front side for retaining the dart. The cells or upright pegs are respectively integral with a respective base block. When the dart hits one base block, a pressure is given to a membrane switch below the corresponding base block, causing a scoring loop to automatically count the score. These electronic dart boards are functional. however they cannot be used with a dart having a metal tip. Because the metal tip may damage the membrane switch and the related circuit boards.

SUMMARY OF THE INVENTION

According to one aspect of the present invention, the electronic dart board comprises an outer frame shell having a plurality of partition ribs defining a set of scoring chambers, and a set of base blocks made of flexible material such as cardboard cork, foamed resin, etc., and respectively mounted in the scoring chambers, wherein a set of block holders are respectively nested in the scoring chambers to hold the base blocks in the respective scoring chambers, the block holders fitting the scoring chambers respectively. When one base block is damaged, it can be conveniently replaced with a new one. According to another aspect of the present invention, the block holders include at least one circular base block, each circular base block having an annular locating groove around the periphery, and the block holder which holds one of the at least one circular base block comprises a plurality of horizontal locating ribs on the inside for engaging into the annular locating groove at the periphery of the corresponding circular base block. According to another aspect of the present invention, the base blocks include at least one side-loading base block, each side-loading base block having two horizontal locating grooves at two opposite sides. The block holder which holds one of the at least one side-loading base block comprises two horizontal locating ribs on the inside respectively engaged into the horizontal locating grooves at the corresponding side-loading base block, and at least one extension tab horizontally outwardly extended from a bottom wall thereof and bent upwards to hold the corresponding side-loading base block in place. According to still another aspect of the present invention, the block holders can be respectively molded from plastics, or made of metal by stamping. A block holder which is made of metal has a peripheral top edge, which is hammered inwards to hold the corresponding base block in place.

DETAILED DESCRIPTION OF THE PREFERRED EMBODIMENT

Figure 1:
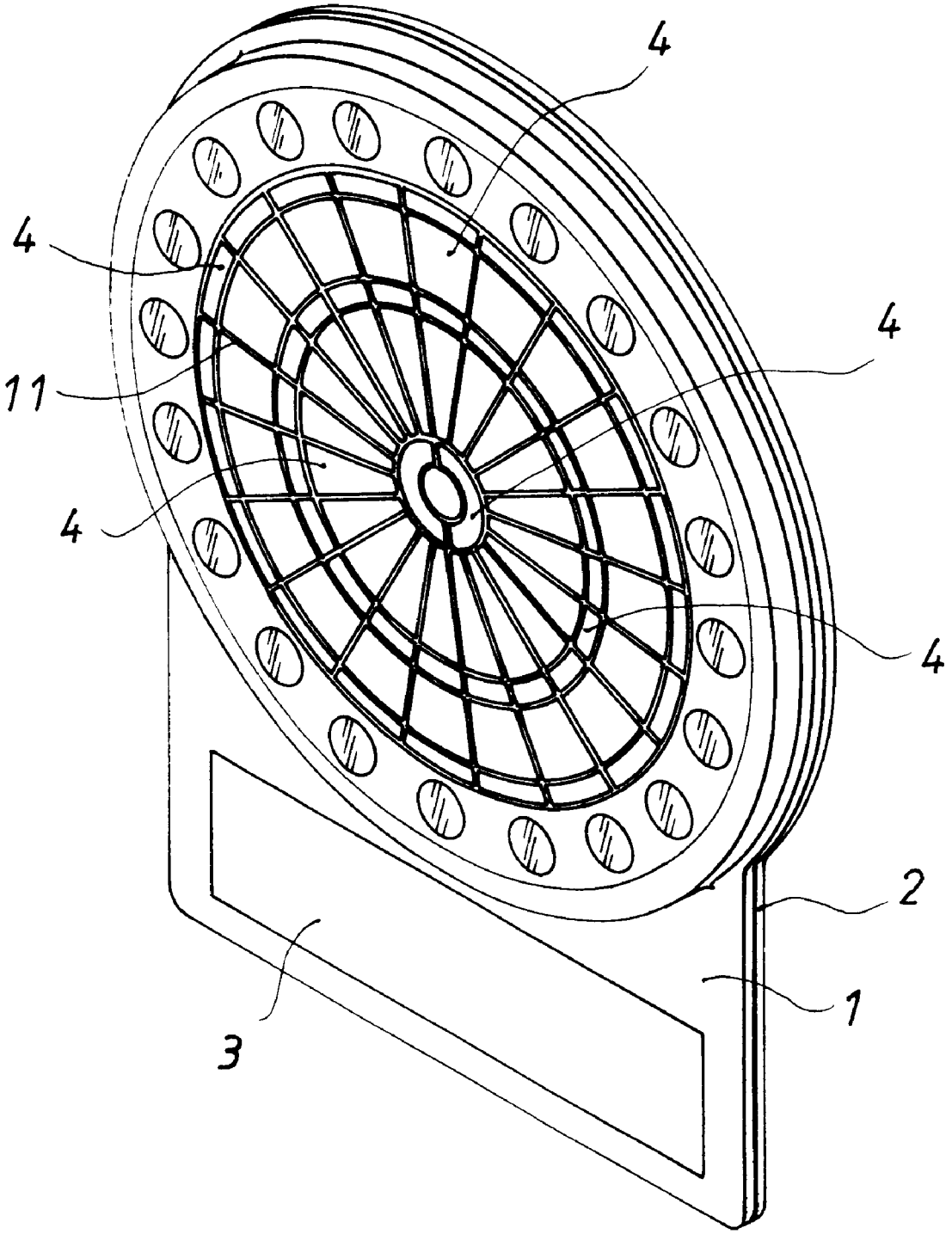
FIG. 1 is an electronic dart board according to the present invention.
Figure 6:
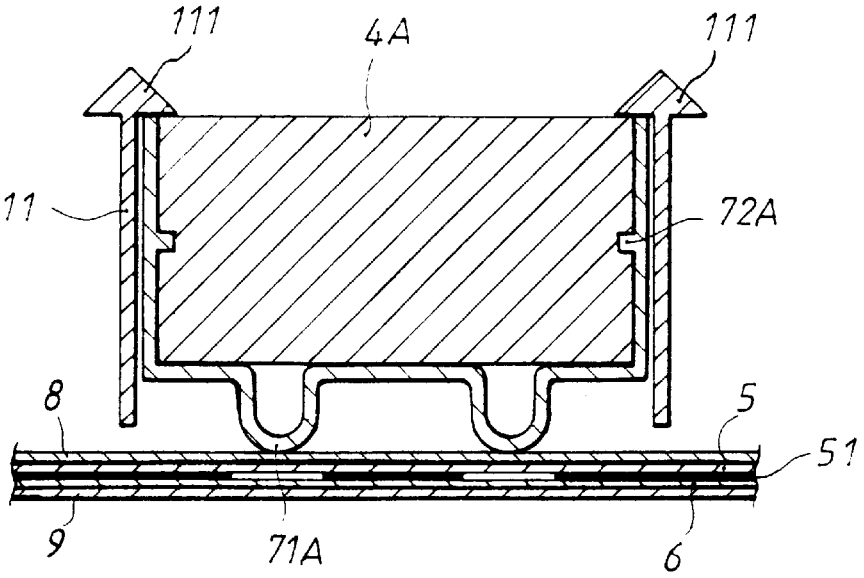
FIG. 6 is a sectional assembly view taken in transverse direction of the second arrangement of the base block and the block holder according to the present invention.

Referring to FIG. 1, an electronic dart board in accordance with the present invention is generally comprised of an outer frame shell 1, a base frame shell 2, a score display 3, and a set of base blocks 4 (a standard dart board is formed of 82 base blocks 4). The outer frame shell 1, the base frame shell 2 and the score display 3 are similar to that of conventional electronic dart boards. The outer frame shell 1 comprises a plurality of partition ribs 11 defining the holding space of the outer frame shell 1 into a set of scoring chambers in which block holders 7 are respectively nested to hold the base blocks 4 respectively. When the block holders 7 and the base blocks 4 are respectively fastened together and inserted into the respective scoring chambers within the outer frame shell 1, the circuit boards 5,6 are pressed together (the circuit board 5,6 are insulated from each other by an insulative sheet 51, which is retained between the circuit boards 5,6 as shown in FIG. 6).

Figure 2:
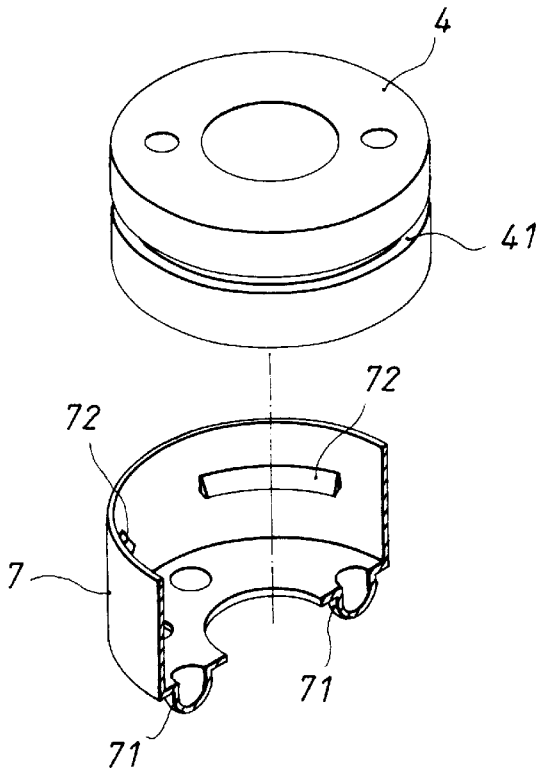
FIG. 2 is an exploded view of a first arrangement of the base block and the block holder according to the present invention.
Figure 5:
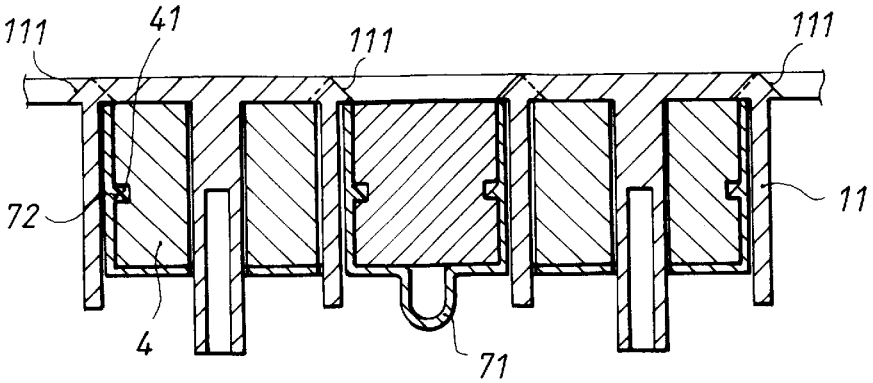
FIG. 5 is an sectional view of a part of the electronic dart board according to the present invention, showing the block holders nested in the respective scoring chambers, the base blocks nested in the respective block holders.
Figure 8:
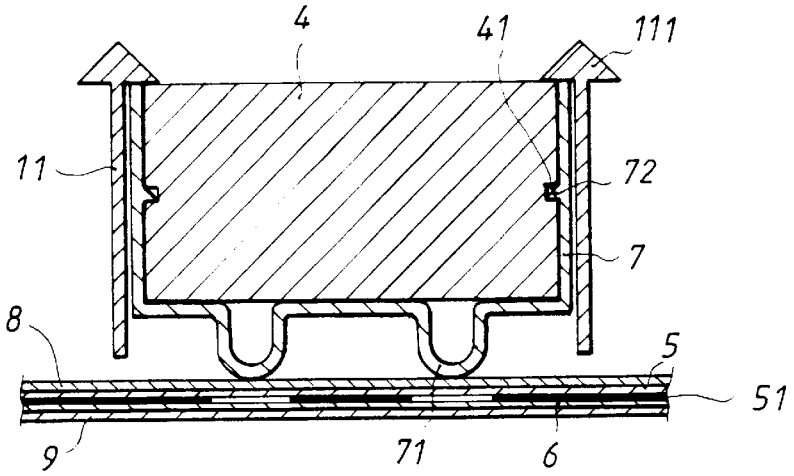
FIG. 8 is a sectional assembly view taken in transverse direction of the first arrangement of the base block and the block holder according to the present invention.
Figure 9:
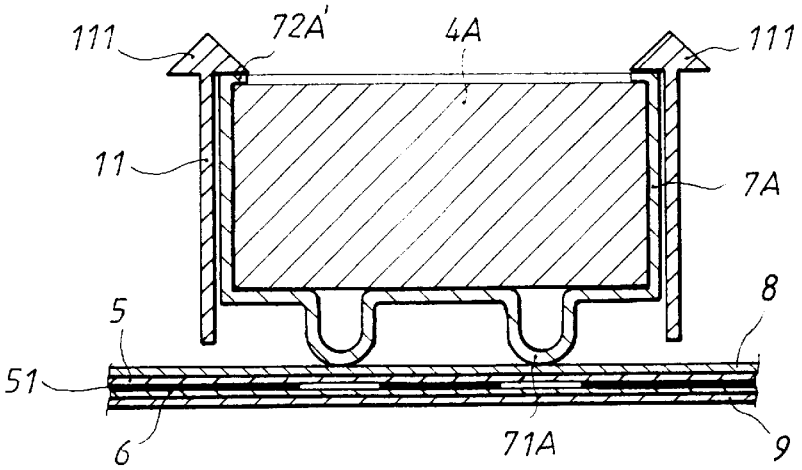
FIG. 9 is a sectional assembly view taken in transverse direction of the third arrangement of the base block and the block holder according to the present invention.

Referring to FIGS. 2, 5 and 8 and FIG. 1 again, the base blocks 4 are respectively made of cardboard cord, foamed plastics. etc., having different shapes respectively fitting the scoring chambers within the outer frame shell 1. The base block 4 shown in FIG. 2 comprises an annular locating groove 41 around the periphery. The block holder 7 which matches the base block 4 shown in FIG. 2 comprises a plurality of legs 71 raised from the bottom side wall thereof, and a plurality of horizontal locating ribs 72 raised around the inside wall thereof The locating ribs 72 each have a sloping top side by which the locating ribs 72 can be conveniently engaged into the annular locating groove 41 on the base block 4. When the base block 4 and the block holder 7 are fastened together and inserted into the corresponding scoring chamber within the outer frame shell 1, the assembly of the base block 4 and the block holder 7 is retained in place by arrowhead-like flanges 111 at the partition ribs 11 (see FIG. 5).

Figure 3:
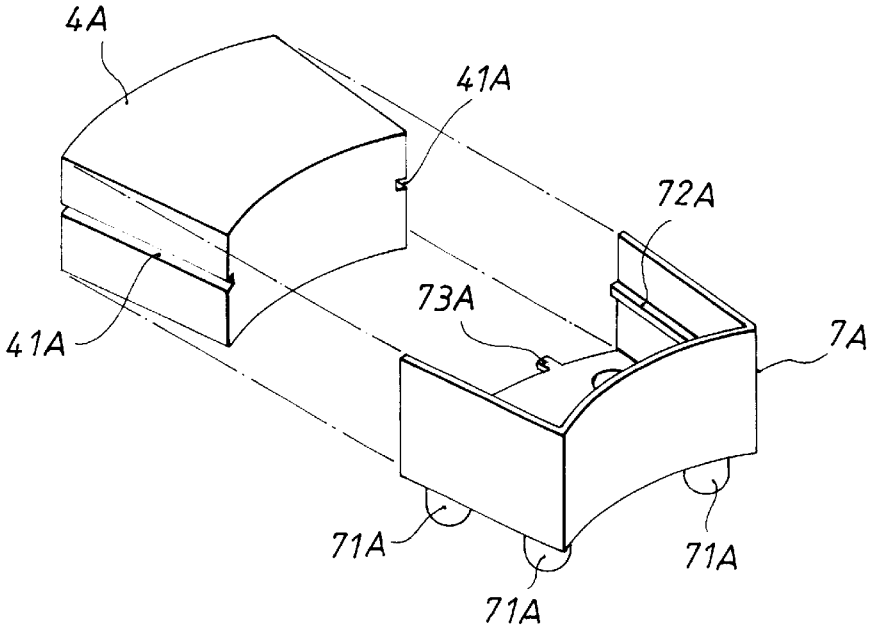
FIG. 3 is an exploded view of a second arrangement of the base block and the block holder according to the present invention.
Figure 7:
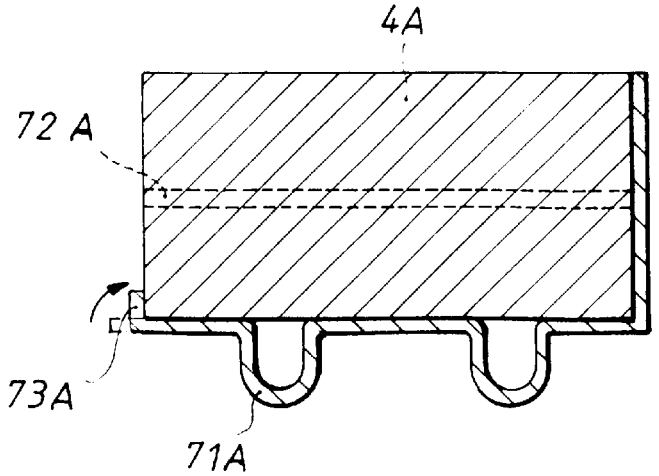
FIG. 7 is a sectional assembly view taken in longitudinal direction of the second arrangement of the base block and the block holder according to the present invention.

Referring to FIGS. 3 and 7, the base block 4A has two locating grooves 41A at two opposite vertical side walls thereof: the matching block holder 7A is designed for side loading, comprising a plurality of legs 71A downwardly extended from the bottom side wall thereof, two horizontal locating ribs 72A bilaterally disposed on the inside for engaging into the locating grooves 41A on the base block 4A. and at least one extension tab 73A horizontally outwardly extended from the bottom wall. When the base block 4A is nested within the block holder 7A, the extension tab 73A is bent upwards to hold down the base block 4A in the block holder 7A.

Figure 4:
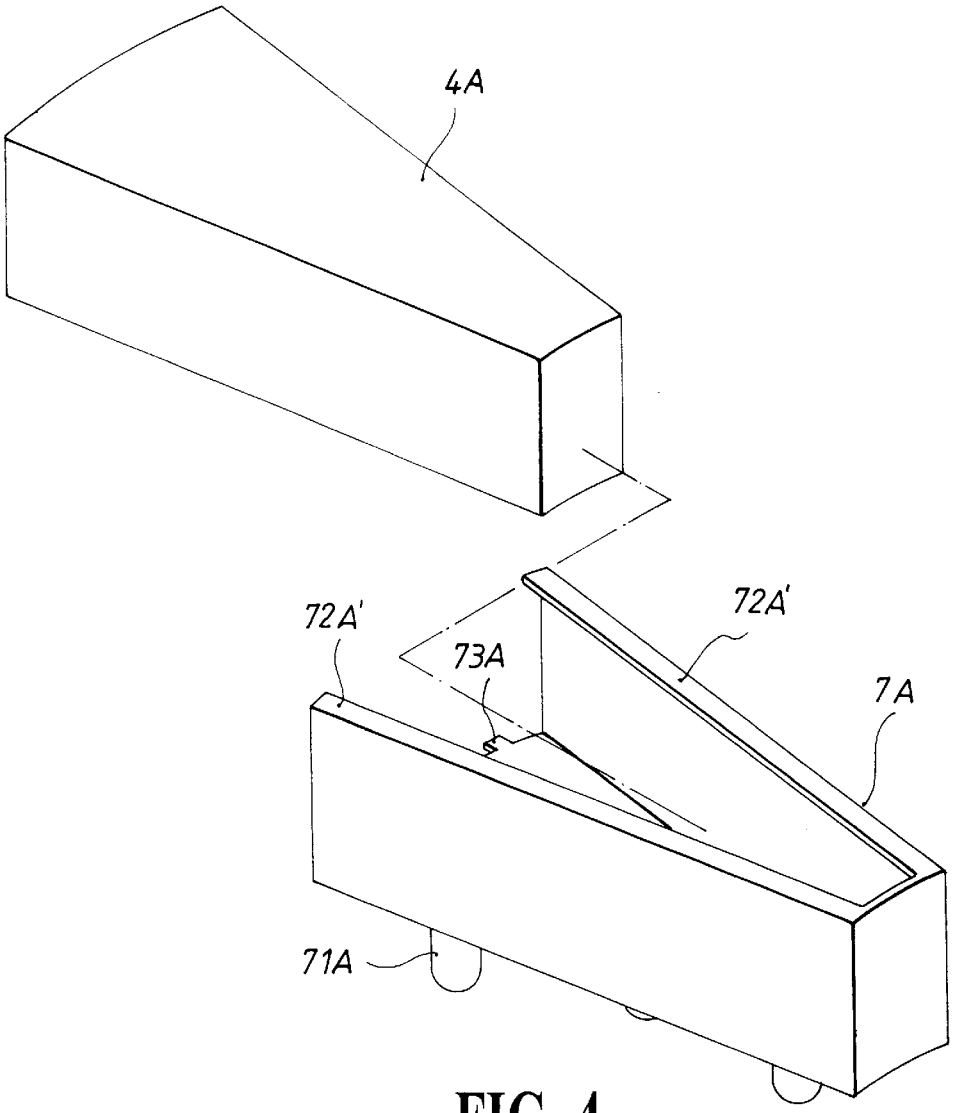
FIG. 4 is an exploded view of a third arrangement of the base block and the block holder according to the present invention.

Referring to FIG. 4, the block holder 7A is made having a plurality of legs 71A downwardly extended from the bottom side wall thereof, two inward locating flanges 72A' perpendicularly inwardly raised from the two vertical side walls thereof at the top, and at least one extension tab 73A horizontally outwardly extended from the bottom wall. When the matching base block 4A is inserted into the block holder 7A. the extension tab 73A is bent upwards, enabling the base block 4A to be held in place inside the block holder 7A by the extension tab 73A and the locating flanges 72A'.

Figure 10:
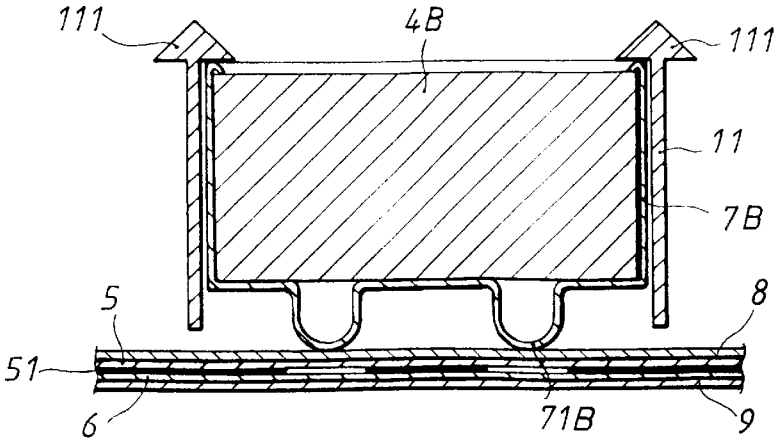
FIG. 10 is a sectional assembly view taken in transverse direction of a fourth arrangement of the base block and the block holder according to the present invention.
Figure 11:
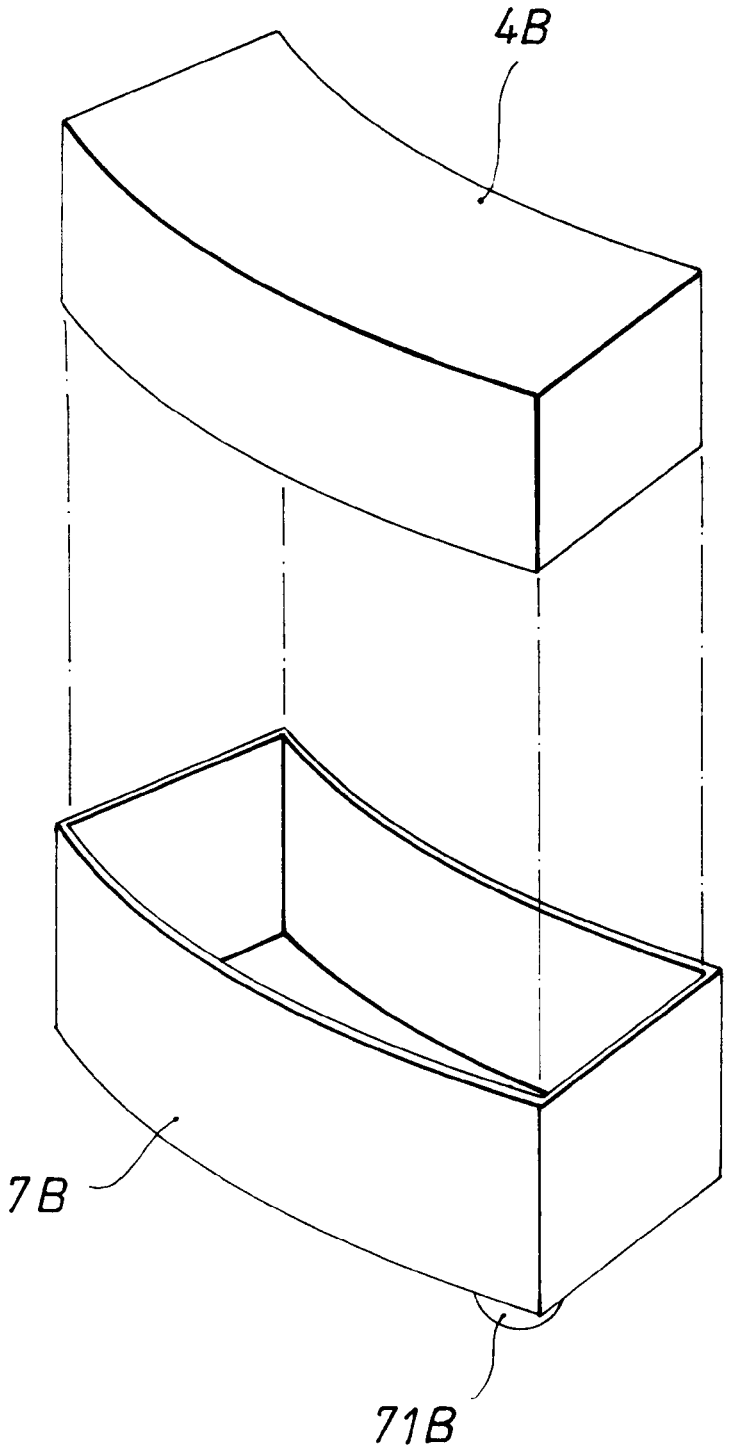
FIG. 11 is an exploded view of the fourth arrangement of the base block and the block holder according to the present invention.

Referring to FIGS. 10 and 11, the block holder 7B is a top-open box made of metal (for example, aluminum film, iron sheet, tin sheet, etc.), having a plurality of legs 71B at the bottom side. The matching base block 4B is made of cardboard, cork, etc. After the base block 4B has been fitted into the block holder 7B, the peripheral top edge of the block holder 7B is hammered down, forming an inward flange hooked on the top side wall of the base block 4B.

Referring to FIGS. 6, 8, 9 and 10. a sound absorbing (plastic or rubber) sheet 9 is arranged below the lower circuit board 6. and a flexible anti-skid sheet 8 (of about 0.5 mm~1 mm thick) is covered on the upper circuit board 5 and retained below the block holders 4,4A,4B. This arrangement eliminates the production of noise and prevents a displacement of the circuit boards 5,6 during playing.

What the invention claimed is:

1. An electronic dart board comprising an outer frame shell having a plurality of partition ribs defining a set of scoring chambers, and a set of base blocks respectively mounted in said scoring chambers, wherein a set of block holders are respectively nested in said scoring chambers to hold said base blocks in the respective scoring chambers, said block holders fitting said scoring chambers respectively, said block holders each having a plurality of legs at a bottom side, said base blocks are made of flexible material and nested in said block holders respectively, wherein said base blocks include at least one circular base block, said at least one circular base block having an annular locating groove around the periphery, and the block holder which holds one of said at least one circular base block comprises a plurality of horizontal locating ribs on an inside for engaging into an annular locating groove at a periphery of the corresponding circular base block, said horizontal locating ribs each having a sloping top side wall.

2. An electronic dart board comprising an outer frame shell having a plurality of partition ribs defining a set of scoring chambers, and a set of base blocks respectively mounted in said scoring chambers, wherein a set of block holders are respectively nested in said scoring chambers to hold said base blocks in the respective scoring chambers, said block holders fitting said scoring chambers respectively, said block holders each having a plurality of legs at a bottom side, said base blocks are made of flexible material and nested in said block holders respectively, wherein said base blocks include at least one side-loading base block, said side-loading block each having two horizontal locating grooves at two opposite sides, and the block holder which holds one of said at least one side-loading base block comprises two horizontal locating ribs on an inside respectively engaged into horizontal locating grooves at the corresponding side-loading base block, and at least one extension tab horizontally outwardly extended from a bottom wall thereof and bent upwards to hold the corresponding side-loading base block in place.

3. An electronic dart board comprising an outer frame shell having a plurality of partition ribs defining a set of scoring chambers, and a set of base blocks respectively mounted in said scoring chambers, wherein a set of block holders are respectively nested in said scoring chambers to hold said base blocks in the respective scoring chambers, said block holders fitting said scoring chambers respectively, said block holders each having a plurality of legs at a bottom side, said base blocks are made of flexible material and nested in said block holders respectively, wherein said block holders are respectively molded from plastics.

4. The electronic dart board of claim 1 wherein said block holders are respectively made of metal by stamping, each having a peripheral top edge hammered inwards to hold the corresponding base block in place.

5. The electronic dart board of claim 2, wherein said block holders are respectively made of metal by stamping, each having a peripheral top edge hammered inwards to hold the corresponding base block in place.

6. The electronic dart board of claim 3, wherein said block holders are respectively made of metal by stamping, each having a peripheral top edge hammered inwards to hold the corresponding base block in place.

* * * * *